US007482563B2

(12) United States Patent
Song et al.

(10) Patent No.: US 7,482,563 B2
(45) Date of Patent: Jan. 27, 2009

(54) MICROWAVE RANGE CONFIGURED BOTH TO HEAT FOOD AND TO EXHAUST CONTAMINATED AIR GENERATED BY A COOKING APPLIANCE PROVIDED THEREBENEATH

(75) Inventors: Sung Bae Song, Gyeonggi-do (KR); Sang Bum Sohn, Seoul (KR); Jong Sik Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/930,721

(22) Filed: Oct. 31, 2007

(65) Prior Publication Data

US 2008/0156793 A1 Jul. 3, 2008

(30) Foreign Application Priority Data

Dec. 27, 2006 (KR) ..... 10-2006-0134383

(51) Int. Cl.
*H05B 6/80* (2006.01)
*F24C 15/20* (2006.01)

(52) U.S. Cl. ..... 219/757; 219/681; 126/21 A; 126/299 D

(58) Field of Classification Search ..... 219/757, 219/756, 681, 400; 126/21 A, 21 R, 299 R, 126/299 D See application file for complete search history.

(56) References Cited

U.S. PATENT DOCUMENTS

| | | | | |
|---|---|---|---|---|
| 4,327,274 | A * | 4/1982 | White et al. | 219/757 |
| 6,018,158 | A * | 1/2000 | Kang | 219/757 |
| 6,239,419 | B1 * | 5/2001 | Kim | 219/757 |
| 7,180,041 | B2 | 2/2007 | Song et al. | |
| 2003/0218012 | A1 * | 11/2003 | Kim | 219/757 |
| 2007/0210065 | A1 | 9/2007 | Sohn et al. | |

OTHER PUBLICATIONS

U.S. Appl. No. 11/930,676 to Song et al., which was filed Oct. 31, 2007.

* cited by examiner

*Primary Examiner*—Philip H Leung
(74) *Attorney, Agent, or Firm*—Greenblum & Bernstein, P.L.C.

(57) ABSTRACT

A microwave range includes a primary air inlet through which contaminated air is drawn in and an auxiliary air inlet through which contaminated air is drawn in. A primary vent fan assembly draws in and exhausts contaminated air drawn in through the primary air inlet, and an auxiliary vent fan assembly draws in and exhausts contaminated air drawn in through the auxiliary air inlet.

19 Claims, 3 Drawing Sheets

MICROWAVE RANGE CONFIGURED BOTH TO HEAT FOOD AND TO EXHAUST CONTAMINATED AIR GENERATED BY A COOKING APPLIANCE PROVIDED THEREBENEATH

CROSS REFERENCE TO RELATED APPLICATION

The present disclosure relates to subject matter contained in priority Korean Patent Application No. 2006-0134383, filed Dec. 27, 2006, which is herein expressly incorporated by reference in its entirety.

BACKGROUND

The present disclosure relates to a microwave range, and more particularly, to a microwave having a hood that exhausts contaminated air generated during a cooking operation of a cooking appliance installed below the microwave range.

A related art microwave range is a cooking appliance for heating food using microwaves or heat from a heater. An available microwave range includes a hood that filters contaminated matter from air including an exhaust gas generated during a cooking operation of a cooking appliance installed below the microwave range and exhausts the filtered air to an indoor space or an outdoor space.

However, a related art microwave range having a hood has the following limitations.

A related art microwave range provides only one vent fan assembly for performing a hood function. Accordingly, in the case where a large amount of exhaust gas is generated from a cooking appliance installed below a microwave range having a hood, contaminated air containing the exhaust gas cannot be sufficiently exhausted to an indoor space or an outdoor space.

Also, an air inlet for intaking contaminated air is generally formed at only the center on the bottom of the microwave range having the hood. Therefore, an exhaust gas generated from a cooking appliance positioned toward the front below the microwave range having the hood cannot be efficiently exhausted to an indoor or outdoor space even when the vent fan assembly is driven.

SUMMARY

Embodiments provide a microwave range having a hood function that is configured to efficiently perform a hood function.

According to an aspect of the present invention, a microwave range includes a primary air inlet through which contaminated air is drawn in; an auxiliary air inlet through which contaminated air is drawn in; a primary vent fan assembly that draws in and exhausts contaminated air drawn in through the primary air inlet; and an auxiliary vent fan assembly that draws in and exhausts contaminated air drawn in through the auxiliary air inlet.

The auxiliary air inlet and the primary air inlet may be located on a bottom surface of the microwave range, and the primary air inlet may be positioned rearward of the auxiliary air inlet. The primary air inlet and the auxiliary air inlet may be located on a bottom surface of the microwave range, the auxiliary air inlet may be positioned forward of the primary air inlet, and the auxiliary vent fan assembly may be located in a lower portion of the microwave range rearward of the primary air inlet.

The microwave range may further include a shield that prevents contaminated air exhausted from the auxiliary vent fan assembly from being exhausted through the primary air inlet. The microwave range may further include a divider that separates at least a portion of a passage through which contaminated air drawn in through the primary air inlet flows from a passage through which contaminated air drawn in through the auxiliary air inlet flows.

According to another aspect of the present invention, a microwave range having a hood for removing contaminated air includes a base plate located at a lower portion of the microwave range, the base plate including at least one primary air inlet and at least one auxiliary air inlet through which contaminated air is drawn in. The microwave range further includes a primary vent fan assembly that draws in and exhausts contaminated air drawn in through the primary air inlet; an auxiliary vent fan assembly that draws in and exhausts contaminated air drawn in through the auxiliary air inlet; and a duct including a passage through which contaminated air drawn in through the auxiliary air inlet flows to the auxiliary vent fan assembly.

The auxiliary air inlet may be formed in the base plate forward of the primary air inlet, and the passage may be provided inside the duct in a portion excluding the primary air inlet. The duct may include an exhaust opening through which contaminated air exhausted by the auxiliary vent fan assembly is exhausted to an outside of the passage. The auxiliary vent fan assembly may exhaust contaminated air through the exhaust opening toward the primary vent fan assembly. The base plate may extend obliquely downward from its front end to its rear end at the lower portion of the microwave range.

According to another aspect of the present invention, a microwave range having a hood for removing contaminated air includes a primary air inhaling passage through which contaminated air drawn in through a primary air inlet flows to a primary vent fan assembly by driving of the primary vent fan assembly; and an auxiliary air inhaling passage through which contaminated air drawn in through an auxiliary air inlet flows to an auxiliary vent fan assembly by driving of the auxiliary vent fan assembly.

The contaminated air drawn in through the primary air inlet may flow upward within the primary air inhaling passage. The primary air inhaling passage may be provided between an inner chamber and inner side surfaces of an outer case.

The primary air inhaling passage may include a first primary air inhaling passage provided between an inner chamber and a base plate installed at a lower portion of the microwave range, the base plate including the primary air inlet and the auxiliary air inlet; and a second primary air inhaling passage provided between the chamber and a back plate provided at a rear end of the microwave range, wherein a rear end of the first primary air inhaling passage communicates with a lower end of the second primary air inhaling passage, and an upper end of the second primary air inhaling passage communicates with the an inlet of the primary vent fan assembly.

The auxiliary air inhaling passage may be formed inside an auxiliary air inhaling duct provided on an upper surface of a base plate, the base plate including the primary air inlet and the auxiliary air inlet.

The microwave range may further include a primary exhaust passage through which contaminated air exhausted by driving of the primary vent fan assembly flows; and an auxiliary exhaust passage through which contaminated air exhausted by driving of the auxiliary vent fan assembly flows.

The primary exhaust passage may be provided on an upper side of an inner chamber, and contaminated air flowing through the primary exhaust passage may be exhausted to an indoor space via an indoor air outlet formed in a front of the microwave range, or exhausted to an outdoor space via an outdoor air outlet formed in a top of an outer case. Contaminated air flowing through the auxiliary exhaust passage may flow through the primary exhaust passage by driving of the auxiliary vent fan assembly and is exhausted together with contaminated air drawn in through the primary air inlet by driving of the primary vent fan assembly. At least portions of the primary air inhaling passage and the auxiliary exhaust passage may be separated by a dividing plate, and air drawn in through the auxiliary air inlet and flowing through the auxiliary exhaust passage flows through the primary exhaust passage and is exhausted by driving of the primary vent fan assembly.

According to the present disclosure, a hood function can be more effectively performed. The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the preferred embodiments of the present invention, examples of which are illustrated in the accompanying drawings.

Figure 1:
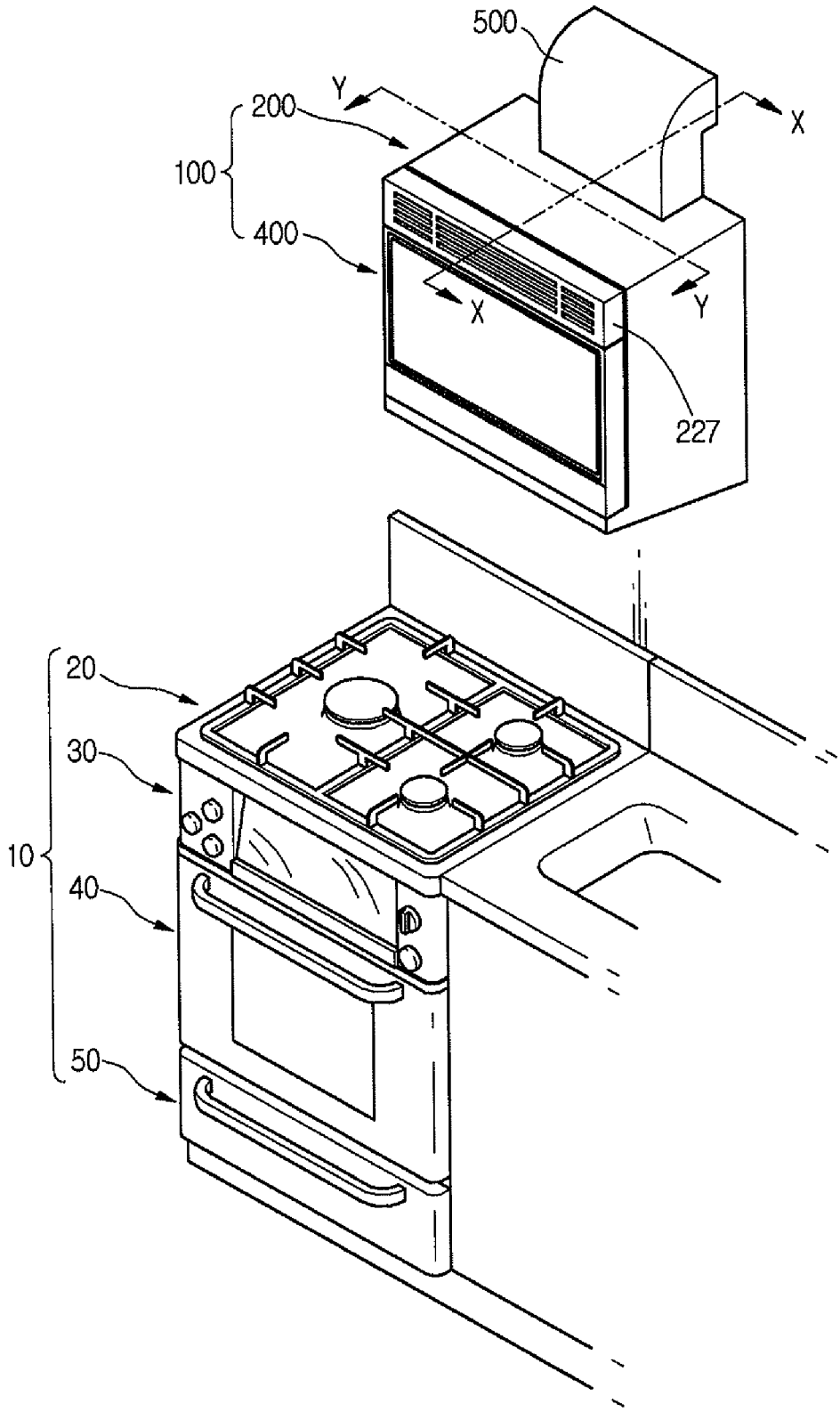
FIG. 1 is a perspective view of a microwave range having a hood installed according to an embodiment.
Figure 2:
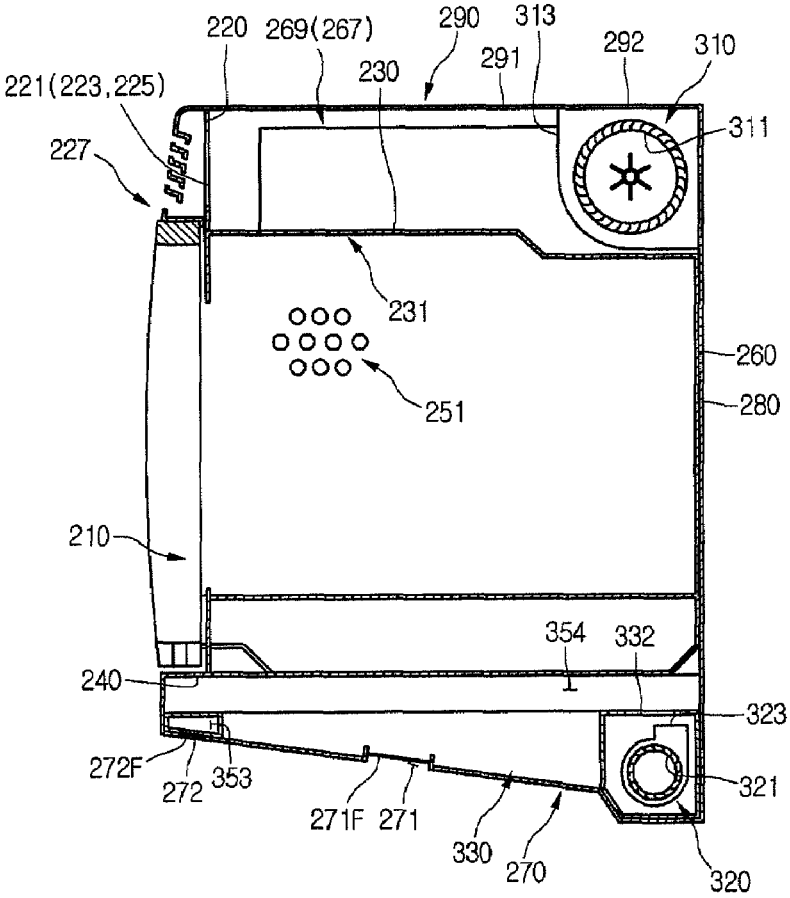
FIG. 2 is a longitudinal cross-sectional view of a portion taken along an X direction of FIG. 1.
Figure 3:
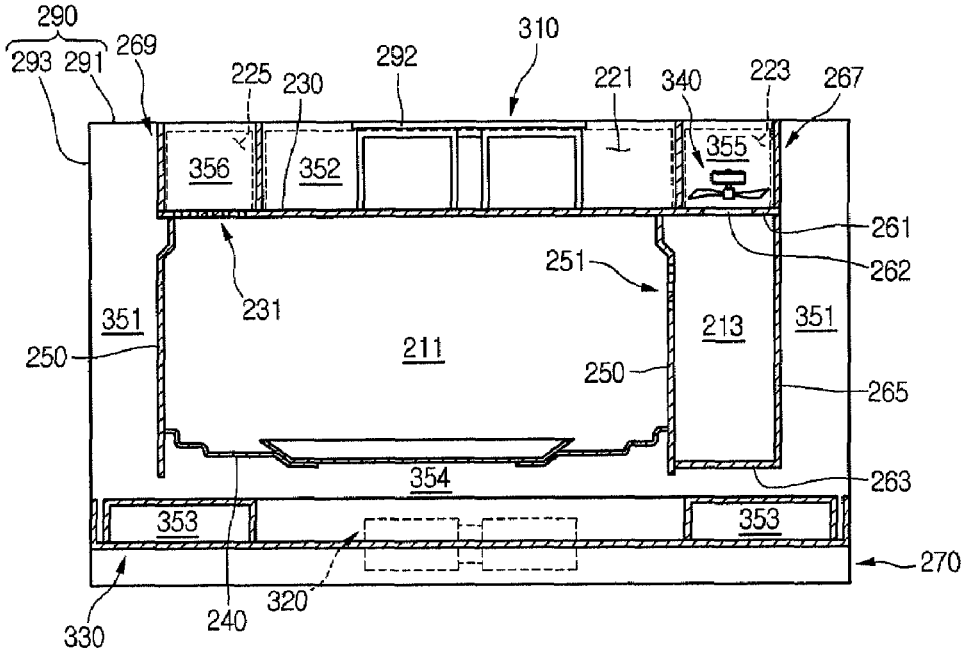
FIG. 3 is a longitudinal cross-sectional view of a portion taken along a Y direction of FIG. 1.
Figure 4:
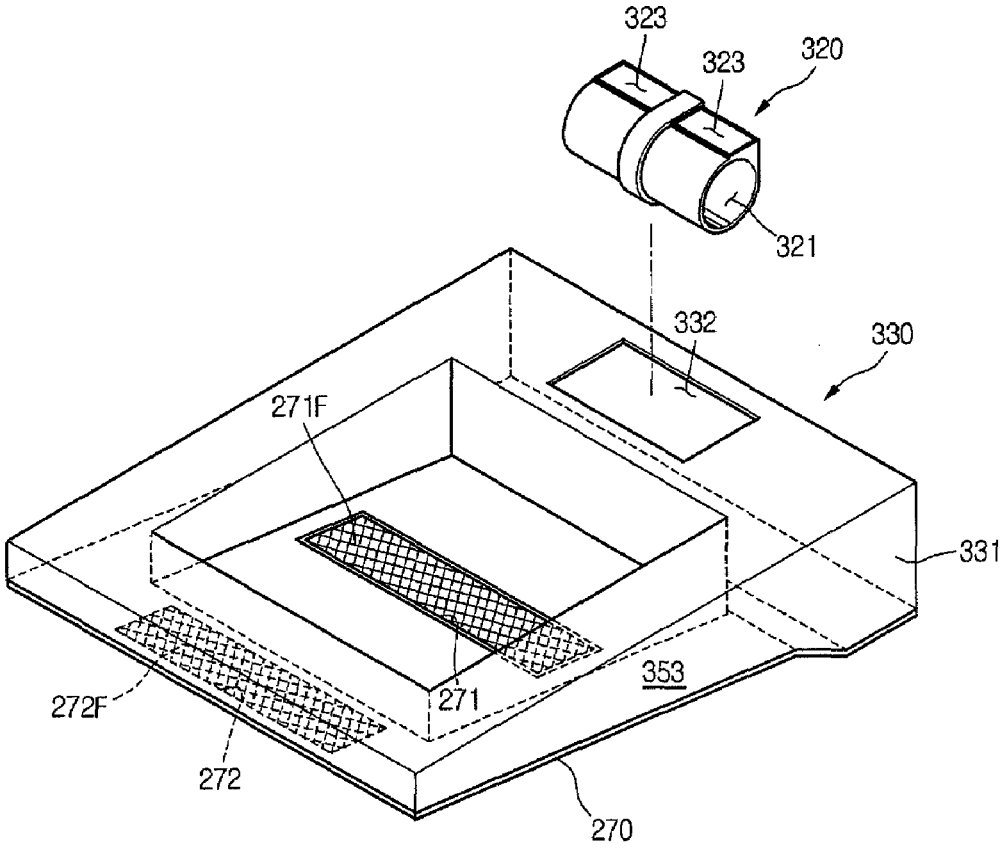
FIG. 4 is a perspective view of a portion according of the microwave range according to the embodiment.

FIG. 1 is a perspective view of a microwave range having a hood installed according to an embodiment, FIG. 2 is a longitudinal cross-sectional view of a portion taken along an X direction of FIG. 1, FIG. 3 is a longitudinal cross-sectional view of a portion taken along a Y direction of FIG. 1, and FIG. 4 is a perspective view of a portion of the microwave range according to the embodiment.

Referring to FIGS. 1 to 4, a gas oven range 10 is installed in a kitchen. The gas oven range 10 includes a top burner unit 20, a grill unit 30, an oven unit 40, and a drawer unit 50. The top burner unit 20 performs a food cooking operation using combustion of a gas. Also, the grill unit 30, the oven unit 40, and the drawing unit 50 perform a food cooking operation using a heater. Although a gas oven range is shown in FIG. 1, the microwave range according to the present invention can be located above any suitable type of cooking appliance.

A microwave range 100 having a hood (referred to as a microwave range 100 hereinafter) is installed in the kitchen above the gas oven range 10. The microwave range 100 performs a cooking function of cooking food using microwaves and/or heat from heater, and a hood function of filtering contaminated matter from air including an exhaust gas generated during a cooking operation at the gas oven range 10 and exhausting the filtered air to the outside. The microwave range 100 includes a main unit 200 and a door 400. Also, the main unit 200 is provided at its upper surface with an outdoor duct 500 for exhausting contaminated air to the outside.

Referring to FIGS. 2 and 3, a front plate 220 forms the front side of a chamber 210 constituting the main unit 200. Also, a top plate 230, a bottom plate 240, a pair of side plates 250, and a rear plate 260 form the upper and lower sides, both side surfaces, and rear surface of the chamber 210, respectively.

The front plate 220 is provided at its upper end with an indoor air outlet 221 for a hood, an air inlet 223 for cooling, and an air outlet 225 for cooling. Referring to FIG. 3, the air inlet 223 for cooling and the air outlet 225 for cooling are provided in the right and left sides around the indoor air outlet 221 for the hood, respectively. The indoor air outlet 221 for the hood is designed for exhausting contaminated air to an indoor space. The air inlet 223 for cooling and the air outlet 225 for cooling are designed for inhaling and exhausting air for cooling electric components which will be described below, respectively.

A vent grill 227 (refer to FIG. 1) is provided to the front upper end of the front plate 220 that corresponds to the indoor air outlet 221 for the hood, the air inlet 223 for cooling, and the air outlet 225 for cooling. The vent grill 227 shields the indoor air outlet 221 for the hood, the air inlet 223 for cooling, and the air outlet 225 for cooling, and allows air to be exhausted in a predetermined direction.

The side plates 250 and the top plate 230 are respectively provided with a plurality of air inhaling through holes 251 and exhaust through holes 231. The air inhaling through holes 251 and the exhaust through holes 231 are designed for communication with a cooking room 211, an electric component room 213, and an exhaust passage 356 for cooling.

The cooking room 211 is provided inside the chamber 210. The cooking room 211 is a portion where food is cooked. The cooking room 211 is selectively opened/closed using the door 400.

A top bracket 261 and a bottom bracket 263 extend to the right from the upper and lower ends of one of the side plates 250, that is, the side plate on the right in the present embodiment. At this point, the front and rear ends of the top bracket 261 and the bottom bracket 263 are closely attached on the rear sides of the front plate 220 and a back plate 280, respectively, which will be described below. Also, the right ends of the top bracket 261 and the bottom bracket 263 are separated a predetermined distance from the inside of one of the sides 293 of an outer case 290. The top bracket 261 is provided at its one side with a communication opening 262. The communication opening 262 is designed for allowing the electric component room 213 to communicate with an air introduction passage 355 for cooling.

A cover bracket 265 is provided to the right ends of the top bracket 261 and the bottom bracket 263. The front and rear ends of the cover bracket 265 are closely attached on the rear sides of the front plate 220 and the back plate 280, respectively. Also, the upper and lower ends of the cover bracket 265 are closely attached on the right ends of the top bracket 261 and the bottom bracket 263.

The top bracket 261, the bottom bracket 263, and the cover bracket 265 substantially form the ceiling surface, the bottom surface, and one side surface of the electric component room 213. That is, the electric component room 213 is substantially formed by the side plate 250, one of both sides 293 of the outer case 290, the top bracket 261, the bottom bracket 263, and the cover bracket 265. A variety of electric components for oscillating microwaves such as a magnetron, a high voltage capacitor, and a high voltage transformer are installed in the electric component room 213.

The top plate 230 is provided with a pair of air guides 267 and 269. In FIG. 3, the air guide 267 on the right is referred to as a first air guide 267, and the air guide 269 on the left is referred to as a second air guide 269 hereinafter. The first and second air guide 267 and 269 substantially divide a passage provided between the top plate 230 and the upper surface 291 of the outer case 290 into a primary exhaust passage 352, an air inhaling passage 355 for cooling, and an exhaust passage 356 for cooling. Each of the first and second air guides 267 and 269 is formed in a □shape that opens to the front. Each of the first and second air guides 267 and 269 is formed long in a back and forth direction on the upper surface of the top plate 230 such that the open front portion communicates with the air inlet 223 for cooling and the air outlet 225 for cooling. At this point, the front ends of the first and second air guides 267 and 269 are closely attached on the rear side of the front plate 220, and the rear ends of the first and second air guides 267 and 269 are separated a predetermined distance from the rear side of the back plate 280. This is for installing the primary vent fan assembly 310. In the present embodiment, the first air guide 267 is substantially provided over the top plate 230 and the top bracket 261.

A base plate 270 is installed at a lower portion of the chamber 210. The base plate 270 substantially forms a lower appearance of the main unit 200. The base plate 270 is installed to lower portion of the chamber 210 such that lower surface of the bottom plate 240 and upper surface of the base plate 270 are vertically separated a predetermined distance from each other. Therefore, a predetermined space is formed between the bottom plate 240 and the base plate 270. An auxiliary air inhaling passage 353 for a hood is provided in the space. The base plate 270 is installed below the chamber 210 to be inclined downward from the front end to the rear end.

The base plate 270 is provided with a primary air inlet 271 for a hood and an auxiliary air inlet 272 for a hood. The primary air inlet 271 for the hood and the auxiliary air inlet 272 for the hood are formed by cutting a portion of the base plate 270 in a predetermined shape. The air inlets may be of any suitable shape, such as a horizontally extending rectangular shape. The primary air inlet 271 for the hood and the auxiliary air inlet 272 for the hood serve as entries through which contaminated air is inhaled. The primary air inlet 271 for the hood is formed relatively in a rearward portion of the base plate 270 compared to the auxiliary air inlet 272 for the hood. For example, the primary air inlet 271 for the hood can be formed at an about central portion of the base plate 270, and the auxiliary air inlet 272 for the hood can be formed in the front end of the base plate 270.

The primary and auxiliary air inlets 271 and 272 for the hood are provided with filters 271F and 272F, respectively. The filters 271F and 272F are designed for removing foreign substances contained in contaminated air inhaled via the primary and auxiliary air inlets 271 and 272 for the hood to filter the air.

A back plate 280 is installed to a rear end of the chamber 210. The back plate 280 forms a rear appearance of the main unit 200. The front side of the back plate 280 is closely attached on a rear plate 260. That is, a space where a passage can be provided is not formed between the rear plate 260 and the back plate 280. An outer case 290 is installed at an upper portion and both sides of the chamber 210. The outer case 290 substantially includes an upper surface 291 forming the upper appearance of the main unit 200, and both laterals surfaces 293 forming both lateral appearances of the main unit 200. The upper surface 291 and both lateral surfaces 293 of the outer case 290 are separated vertically and horizontally by a predetermined distance from the top plate 230 and the side plates 250, respectively. Also, an outdoor air outlet 292 for a hood is formed at the rear end on the upper surface 291 of the outer case 290. The outdoor air outlet 292 for the hood is designed for exhausting contaminated air to the outside through the outdoor duct 500.

The primary vent fan assembly 310 is installed at the rear end on the upper surface of the chamber 210. The primary vent fan assembly 310 is designed for providing driving force for inhaling and exhausting contaminated air through the primary air inlet 271. The primary vent fan assembly 310 is installed long horizontally right below the outdoor air outlet 292 for the hood and at the rear end of the top plate 230 that corresponds to the rear end of the primary exhaust passage 352. The primary vent fan assembly 310 includes one fan motor and a pair of primary vent fans. Also, the primary vent fan assembly 310 is provided with a pair of air inlets 311 and discharge portions 313.

The air inlets 311 of the primary vent fan assembly 310 are provided to both ends of the primary vent fan assembly 310, respectively, such that the air inlets 311 face both ends of the chamber 210. Also, the discharge portions 313 of the primary vent fan assembly 310 are provided on one sides of the primary vent fan assembly 310, respectively, to cross the air inlets 311 of the primary vent fan assembly 310 at right angles. In the present embodiment, the primary vent fan assembly 310 is installed such that the discharge portions 313 thereof face the front, that is, the indoor air outlet 221 for the hood. However, the primary vent fan assembly 310 can be installed at the rear end of the top plate 230 such that the discharge portions 313 thereof face upward, that is, face the outdoor air outlet 292 for the hood depending on the arrangement of a kitchen where the microwave range 100 is installed, that is, depending on whether the outdoor duct 500 is provided.

An auxiliary vent fan assembly 320 is installed at the rear end on the upper surface of the base plate 270 below the primary vent fan assembly 310. The auxiliary vent fan assembly 320 is installed long horizontally at the rear end on the upper surface of the base plate 270. The auxiliary vent fan assembly 320 is designed for providing driving force for inhaling and exhausting contaminated air through the auxiliary air inlet 272 for the hood.

The auxiliary vent fan assembly 320 includes one fan motor and a pair of auxiliary vent fans. Also, the auxiliary vent fan assembly 320 is provided with an air inlet 321 and a discharge portion 323. The air inlet 321 of the auxiliary vent fan assembly 320 is provided at both ends of the auxiliary vent fan assembly 320. Also, the discharge portion 323 of the auxiliary vent fan assembly 320 is provided in a direction perpendicular to the air inlet 321 of the auxiliary vent fan assembly 320 on one side of the auxiliary vent fan assembly 320.

Meanwhile, referring to FIG. 4, an auxiliary air inhaling duct 330 is provided in a space between the bottom plate 240 and the base plate 270. The auxiliary air inhaling duct 330 is designed for flowing contaminated air inhaled via the auxiliary air inlet 272 for the hood to the auxiliary vent fan assembly 320. For this purpose, the auxiliary air inhaling passage 353 for the hood is provided inside the auxiliary air inhaling duct 330.

The auxiliary air inhaling duct 330 is formed in a tube shape having an about □shaped cross-section and provided on the upper surface of the base plate 270 that excludes the primary air inlet 271 for the hood. At this point, the front end of the auxiliary inhaling duct 330 communicates with the auxiliary air inlet 272 for the hood.

The auxiliary air inhaling duct 330 is provided at its rear end with a fan installation portion 331. The fan installation portion 331 denotes the rear end of the auxiliary air inhaling duct 330 where the auxiliary vent fan assembly 320 is installed. The fan installation portion 331 is provided at its upper surface with an exhaust opening 332. The exhaust opening 332 serves an exit for exhausting contaminated air flowing through the inside of the auxiliary inhaling duct 330, that is, the auxiliary air inhaling passage 353 for the hood by driving of the auxiliary vent fan assembly 320 to the outside of the auxiliary air inhaling duct 330. In the present embodiment, the exhaust opening 332 is provided in an upper surface at the rear end of the auxiliary air inhaling duct 330 to exhaust contaminated air upward by driving of the auxiliary vent fan assembly 320.

Referring to FIG. 3 again, the top bracket 261 above the electric component room 213 is provided with a cooling fan assembly 340. The cooling fan assembly 340 is designed for providing driving force for flowing air cooling the electric components. The cooling fan assembly 340 is installed right above the communication opening 262. Therefore, when the cooling fan assembly 340 operates, air inhaled via the air inlet 223 for cooling flows downward and is delivered to the electric component room 213 via the communication opening 262.

Meanwhile, the chamber 210 is provided with a plurality of passages, i.e., a primary air inhaling passage 351 for a hood, a primary exhaust passage 352 for a hood, the auxiliary air inhaling passage 353 for the hood, an auxiliary exhaust passage 354 for a hood, the air inhaling passage 355 for cooling, and the exhaust passage 356 for cooling. The primary air inhaling passage 351 for the hood, the primary exhaust passage 352 for the hood, the auxiliary air inhaling passage 353 for the hood, and the auxiliary exhaust passage 354 for the hood are portions through which contaminated air flows. The air inhaling passage 355 for cooling, and the exhaust passage 356 for cooling are portions through which air cooling the electric components flows.

The primary air inhaling passage 351 for the hood is a portion through which contaminated air inhaled via the primary air inlet 271 for the hood and delivered to the air inlet 311 of the primary vent fan assembly 310 flows. The primary air inhaling passage 351 for the hood is formed long vertically between the chamber 210 and the insides on both lateral sides of the outer case 290. The lower end of the primary air inhaling passage 351 for the hood communicates with the primary air inlet 271 for the hood, and the upper end of the primary air inhaling passage 351 for the hood communicates with the air inlet 311 of the primary vent fan assembly 310.

The primary exhaust passage 352 for the hood is surrounded by the top plate 230, the inner side on the upper surface 291 of the outer case 290, and the first and second air guides 267 and 269. The front end of the primary exhaust passage 352 for the hood communicates with the indoor air outlet 221 for the hood. Also, the rear end of the primary exhaust passage 352 for the hood communicates with the discharge portion 313 of the primary vent fan assembly 310.

Meanwhile, the auxiliary air inhaling passage 353 for the hood is provided inside the auxiliary air inhaling duct 330. Therefore, the auxiliary air inhaling passage 353 for the hood substantially has a □shaped cross-section corresponding to the auxiliary air inhaling duct 330. The front end of the auxiliary air inhaling passage 353 for the hood communicates with the auxiliary air inlet 272 for the hood. Also, the rear end of the auxiliary air inhaling passage 353 for the hood communicates with the air inlet 321 of he auxiliary vent fan assembly 320 installed in the fan installation portion 331.

The auxiliary exhaust passage 354 for the hood is provided between the bottom plate 240 adjacent to the exhaust opening 332 and the upper surface of the auxiliary air inhaling duct 330. Contaminated air exhausted via the exhaust opening 332 flows through the auxiliary exhaust passage 354. Both sides of the auxiliary exhaust passage 354 for the hood communicate with the primary air inhaling passage 351 for the hood. Therefore, contaminated air exhausted via the exhaust opening 332 and flowing through the auxiliary exhaust passage 354 for the hood is delivered to the primary air inhaling passage 351 for the hood.

The air inhaling passage 355 for cooling is surrounded by the top plate 230, the inner side on the upper surface 291 of the outer case 290, and the first air guide 267. Air inhaled via the air inlet 223 for cooling delivered to the electric component room 213 by driving of the cooling fan assembly 340 flows through the air inhaling passage 355 for cooling.

The exhaust passage 356 for cooling is surrounded by the top plate 230, the inner side on the upper surface 291 of the outer case 290, and the second air guide 269. Air that has cooled the electric components and circulated through the cooking room 211 by driving of the cooling fan assembly 340 flows through the exhaust passage 356 for cooling. For this purpose, the exhaust through holes 231 are substantially formed in one side of the top plate 230 that corresponds to the inside of the air inhaling passage 355 for cooling.

An operation of a microwave range having a hood will be described below according to an embodiment of the present disclosure.

First, a process of circulating contaminated air will be described below according to the microwave range having the hood in an embodiment of the present disclosure.

When a user operates the microwave range, the primary vent fan assembly 310 is driven. When the primary vent fan assembly 310 is driven, contaminated air including an exhaust gas generated during a cooking operation in a gas oven range 10 is inhaled via the primary air inlet 271 for the hood to flow through the primary air inhaling passage 351 for the hood. While the contaminated air is inhaled via the primary air inlet 271 for the hood, various foreign substances contained in the contaminated air are filtered by the filters 271F and 272F.

Meanwhile, air flowing through the primary air inhaling passage 351 for the hood is inhaled to the air inlet 311 of the primary vent fan assembly 310. Also, the air inhaled to the air inlet 311 of the primary vent fan assembly 310 is exhausted to the discharge portion 313 of the primary vent fan assembly 310.

The air exhausted to the discharge portion 313 of the primary vent fan assembly 310 flows through the primary exhaust passage 352 for the hood and is exhausted to an indoor space via the indoor air outlet 221 for the hood and the vent grill 227. Of course, in the case where the discharge portion 313 of the primary vent fan assembly 310 is installed to face upward, that is, face the outdoor air outlet 292 for the hood, air exhausted to the discharge portion 313 of the primary vent fan assembly 310 will be exhausted to the outside via the outdoor air outlet 292 for the hood and the outdoor duct 500.

Meanwhile, when the user operates the microwave range, the primary vent fan assembly 310 is driven, and simultaneously the auxiliary vent fan assembly 320 is driven. Therefore, contaminated air flows through the auxiliary air inhaling passage 353 for the hood via the auxiliary air inlet 272 for the hood. At this point, various foreign substances are filtered by the filter 272F installed in the auxiliary air inlet 272 for the hood.

Also, air flowing through the auxiliary inhaling passage 353 is inhaled to the air inlet 321 of the auxiliary vent fan assembly 320. The air that has been inhaled into the air inlet 321 of the auxiliary vent fan assembly 320 is exhausted to the auxiliary exhaust passage 354 for the hood via the discharge portion 323 and the exhaust opening 332 of the auxiliary vent fan assembly 320. Since the auxiliary exhaust passage 354 for the hood communicates with the primary air inhaling passage 351 for the hood, the air flowing through the auxiliary exhaust passage 354 for the hood is delivered to the primary air inhaling passage 351 for the hood. Therefore, the air that has been inhaled via the auxiliary air inlet 272 for the hood flows through the primary exhaust passage 352 together with air inhaled via the primary air inlet 271 for the hood, and is exhausted to an indoor space or an outdoor space.

Next, a process of circulating air for cooling the electric components will be described according to an embodiment of the present disclosure.

As described above, when a microwave range operates, the cooling fan assembly 340 is driven. Air inhaled via the air inlet 223 for cooling by the driving of the cooling fan assembly 340 flows through the air inhaling passage 355 for cooling.

Also, the air flowing through the air inhaling passage 355 for cooling moves downward by continuous driving of the cooling fan assembly 340 and is delivered to the electric component room 213 via the communication opening 262. The air that has been delivered to the electric component room 213 via the communication opening 262 cools the electric components.

The air that has cooled the electric components is delivered to the inside of the cooking room 211 via the air inhaling through holes 251 by the continuous driving of the cooling fan assembly 340. The air that has been delivered to the inside of the cooking room 211 circulates through the cooking room 211. A variety of foreign substances generated in the inside of the cooking room 211 during a cooking process is included in air while the air circulates through the cooking room 211.

The air that has circulated through the cooling room 211 is delivered to the exhaust passage 356 for cooling via the air exhaust through holes 231. The air that has been delivered to the exhaust passage 356 for cooling is exhausted to an indoor space via the air outlet 225 for cooling and the vent grill 227. Next, a microwave range having a hood will be described below according to another embodiment with reference to the accompanying drawings.

Figure 5:
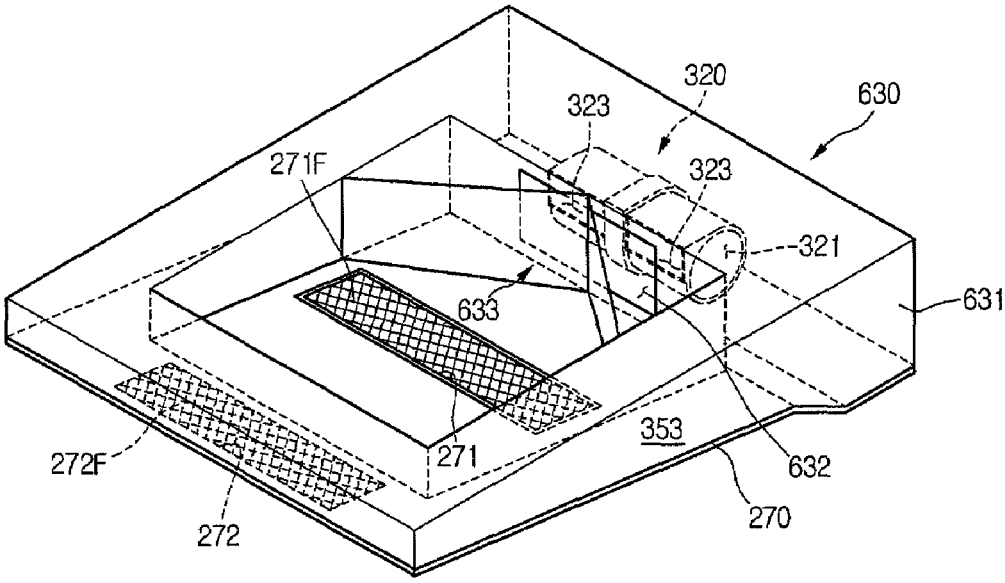
FIG. 5 is a perspective view of a portion of a microwave range having a hood according to another embodiment.

FIG. 5 is a perspective view of a portion of a microwave having a hood according to another embodiment. In description of the second embodiment, same reference numerals of FIGS. 1 to 4 will be used for the same elements as those of the previous embodiment.

Referring to FIGS. 1 to 5, a fan installation portion 631 including an auxiliary vent fan assembly 320 is provided at a rear end of an auxiliary air inhaling duct 630 including an auxiliary air inhaling passage 353 for the hood. Also, an exhaust opening 632 is provided on the inner side of the auxiliary air inhaling duct 630 corresponding to the front end of the fan installation portion 631. That is, when the auxiliary vent fan assembly 320 is driven, air flowing through the auxiliary air inhaling passage 353 for the hood is exhausted to the front, i.e., an auxiliary exhaust passage 354 for the hood via the exhaust opening 632. This is for preventing contaminated air exhausted via the exhaust opening 632 from being directly delivered to an air inlet 311 of the primary vent fan assembly 310, and allowing contaminated air inhaled via a primary air inlet 271 for a hood to be inhaled to the air inlet 311 of the primary vent fan assembly 310 without hindrance.

In more detail, a primary air inhaling passage 351 for a hood can be provided at the rear end of the chamber 210, that is, between a rear plate 260 and a back plate 280. In this case, when the exhaust opening 632 is formed on the upper surface at the rear end of the auxiliary air inhaling duct 630 as in the previous embodiment, contaminated air exhausted via the exhaust opening 632, that is, the contaminated air inhaled via an auxiliary air inlet 272 for a hood is directly delivered to the air inlet 311 of the primary vent fan assembly 310. Therefore, the contaminated air inhaled via the primary air inlet 271 for the hood, that is, the contaminated air flowing through the primary air inhaling passage 351 for the hood is not efficiently inhaled to the air inlet 311 of the primary vent fan assembly 310. Therefore, in the case where the primary air inhaling passage 351 for the hood is provided at the rear end of the chamber 210, the exhaust opening 632 is formed in the inner surface of the auxiliary air inhaling duct 630 as in the present embodiment to prevent the above-described limitation.

When contaminated air exhausted via the exhaust opening 632 is substantially directed to the front, there is possibility that the contaminated air may be exhausted via the primary air inlet 271 for the hood. Also, the contaminated air exhausted via the exhaust opening 632 cannot be efficiently delivered to the primary air inhaling passage 351 for the hood provided at the rear end of the chamber 210.

In the present embodiment, a dividing plate 633 is provided between the primary air inlet 271 for the hood and the exhaust opening 632 to prevent this limitation. The dividing plate 633 divides portions of the primary air inhaling passage 351 for the hood through which contaminated air flows by driving of the primary vent fan assembly 310, and the auxiliary exhaust passage 354 for the hood through which contaminated air flows by driving of the auxiliary vent fan assembly 320. This is for preventing contaminated air exhausted via the exhaust opening 632 from being exhausted to an indoor space via the primary air inlet 271 for the hood, and simultaneously guiding contaminated air exhausted via the exhaust opening 632 to the primary air inhaling passage 351 for the hood. In other words, the dividing plate 633 serves as not only a dividing member for preventing contaminated air exhausted via the exhaust opening 632 flowing through the auxiliary exhaust passage 354 for the hood from being exhausted to an indoor space via the primary air inlet 271 for the hood, but also as a guide member for guiding the contaminated air to the primary air inhaling passage 351 for the hood.

Also, the dividing plate 633 is formed such that a flowing cross-section area of the auxiliary exhaust passage 354 for the hood through which contaminated air flows increases from the exhaust opening 632 to a flowing direction, that is, toward the front in order to more efficiently exhaust the contaminated air via the exhaust opening 632. In the present embodiment, the diving plate 633 is formed to have an about V shaped cross-section inclined at a predetermined angle to the front from the central portion of the exhaust opening 632. Of course, the shape of the dividing plate 633 is not limited thereto. For example, the dividing plate 633 can have a U-shaped cross-section.

The following effects are expected according to the above-described microwave range having a hood.

First, the embodiments provide a primary vent fan assembly and an auxiliary vent fan assembly for a hood function. Therefore, even when a large amount of exhaust gases is generated from a cooking appliance, the exhaust gases can be sufficiently exhausted to an indoor or outdoor space via a primary vent fan assembly and an auxiliary vent fan assembly.

Also, an auxiliary air inlet is provided on one side of a base plate that corresponds to the front of a primary air inlet for a hood. Therefore, an exhaust gas generated at the relatively front portion of the cooking appliance that corresponds to the front of the microwave range can be more efficiently exhausted to an indoor or outdoor space.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A microwave range configured to heat food by using microwave or heat energy and to exhaust contaminated air generated by a cooking appliance provided therebeneath, comprising:

a primary air inlet through which contaminated air is drawn in;

an auxiliary air inlet through which contaminated air is drawn in;

a primary vent fan assembly that draws in and exhausts contaminated air drawn in through the primary air inlet; and an auxiliary vent fan assembly that draws in and exhausts contaminated air drawn in through the auxiliary air inlet, wherein the primary air inlet is provided at a lower position than the auxiliary air inlet, and the primary air inlet and the auxiliary air inlet are provided on a same surface.

2. The microwave range according to claim 1, wherein the auxiliary air inlet and the primary air inlet are located on a bottom surface of the microwave range, and the primary air inlet is positioned rearward of the auxiliary air inlet.

3. The microwave range according to claim 1, wherein the primary air inlet and the auxiliary air inlet are located on a bottom surface of the microwave range, the auxiliary air inlet is positioned forward of the primary air inlet, and the auxiliary vent fan assembly is located in a lower portion of the microwave range rearward of the primary air inlet.

4. The microwave range according to claim 1, further comprising a shield that prevents contaminated air exhausted from the auxiliary vent fan assembly from being exhausted through the primary air inlet.

5. The microwave range according to claim 1, further comprising a divider that separates at least a portion of a passage through which contaminated air drawn in through the primary air inlet flows from a passage through which contaminated air drawn in through the auxiliary air inlet flows.

6. A microwave range configured to heat food by using microwave or heat energy and to exhaust contaminated air generated by a cooking appliance provided therebeneath, comprising:

a base plate located at a lower portion of the microwave range, the base plate including at least one primary air inlet and at least one auxiliary air inlet through which contaminated air is drawn in;

a primary vent fan assembly that draws in and exhausts contaminated air drawn in through the primary air inlet;

an auxiliary vent fan assembly that draws in and exhausts contaminated air drawn in through the auxiliary air inlet; and a duct including a passage through which contaminated air drawn in through the auxiliary air inlet flows to the auxiliary vent fan assembly, wherein the primary air inlet is provided at a lower position than the auxiliary air inlet, and the primary air inlet and the auxiliary air inlet are provided on a same surface.

7. The microwave range according to claim 6, wherein the auxiliary air inlet is formed in the base plate forward of the primary air inlet, and the passage is provided inside the duct in a portion excluding the primary air inlet.

8. The microwave range according to claim 7, wherein the duct comprises an exhaust opening through which contaminated air exhausted by the auxiliary vent fan assembly is exhausted to an outside of the passage.

9. The microwave range according to claim 8, wherein the auxiliary vent fan assembly exhausts contaminated air through the exhaust opening toward the primary vent fan assembly.

10. The microwave range according to claim 6, wherein the base plate extends obliquely downward from its front end to its rear end at the lower portion of the microwave range.

11. A microwave range configured to heat food by using microwave or heat energy and to exhaust contaminated air generated by a cooking appliance provided therebeneath comprising:

a primary air inlet through which contaminated air drawn in through a primary air inlet flows to a primary vent fan assembly by driving of the primary vent fan assembly; and an auxiliary air inlet through which contaminated air drawn in through an auxiliary air inlet flows to an auxiliary vent fan assembly by driving of the auxiliary vent fan assembly, wherein the primary air inlet is provided at a lower position than the auxiliary air inlet and the primary air inlet and the auxiliary air inlet are provided on a same surface.

12. The microwave range according to claim 11, wherein the contaminated air drawn in through the primary air inlet flows upward within the primary air inlet.

13. The microwave range according to claim 11, wherein the primary air inlet is provided between an inner chamber and inner side surfaces of an outer case.

14. The microwave range according to claim 11, wherein the primary air inlet comprises:

a first primary air inlet provided between an inner chamber and a base plate installed at a lower portion of the microwave range, the base plate including the primary air inlet and the auxiliary air inlet; and a second primary air inlet provided between the chamber and a back plate provided at a rear end of the microwave range, wherein a rear end of the first primary air inlet communicates with a lower end of the second primary air inlet, and an upper end of the second primary air inlet communicates with an inlet of the primary vent fan assembly.

15. The microwave range according to claim 11, wherein the auxiliary air inlet is formed inside an auxiliary air inlet duct provided on an upper surface of a base plate, the base plate including the primary air inlet and the auxiliary air inlet.

16. The microwave range according to claim 11, further comprising:

a primary exhaust passage through which contaminated air exhausted by driving of the primary vent fan assembly flows; and an auxiliary exhaust passage through which contaminated air exhausted by driving of the auxiliary vent fan assembly flows.

17. The microwave range according to claim 16, wherein the primary exhaust passage is provided on an upper side of an inner chamber, and contaminated air flowing through the primary exhaust passage is exhausted to an indoor space via an indoor air outlet formed in a front of the microwave range, or exhausted to an outdoor space via an outdoor air outlet formed in a top of an outer case.

18. The microwave range according to claim 16, wherein contaminated air flowing through the auxiliary exhaust passage flows through the primary exhaust passage by driving of the auxiliary vent fan assembly and is exhausted together with contaminated air drawn in through the primary air inlet by driving of the primary vent fan assembly.

19. The microwave range according to claim 16, wherein at least portions of the primary air inlet and the auxiliary exhaust passage are separated by a dividing plate, and air drawn in through the auxiliary air inlet and flowing through the auxiliary exhaust passage flows through the primary exhaust passage and is exhausted by driving of the primary vent fan assembly.

* * * * *